US010278435B2

(12) United States Patent
Bye et al.

(10) Patent No.: US 10,278,435 B2
(45) Date of Patent: May 7, 2019

(54) PROTECTIVE GARMENTS AND METHODS OF MAKING

(71) Applicant: Regents of the University of Minnesota, Minneapolis, MN (US)

(72) Inventors: Elizabeth Kersch Bye, Eden Prairie, MN (US); Karen Louise LaBat, Circle Pines, MN (US); Linsey Ann Gordon, St. Paul, MN (US); Theresa Elizabeth Lastovich, St. Louis Park, MN (US)

(73) Assignee: REGENTS OF THE UNIVERSITY OF MINNESOTA, Minneapolis, MN (US)

( * ) Notice: Subject to any disclaimer, the term of this patent is extended or adjusted under 35 U.S.C. 154(b) by 590 days.

(21) Appl. No.: 14/266,130

(22) Filed: Apr. 30, 2014

(65) Prior Publication Data

US 2015/0313295 A1 Nov. 5, 2015

(51) Int. Cl.

| | |
|---|---|
| ***A41B 9/08*** | (2006.01) |
| ***A41F 9/00*** | (2006.01) |
| ***A41D 1/06*** | (2006.01) |
| ***A41D 13/02*** | (2006.01) |

(Continued)

(52) U.S. Cl.

CPC ..... *A41D 13/02* (2013.01); *A41D 2300/22* (2013.01)

(58) Field of Classification Search

CPC ..... A41D 13/02; A41D 13/00; A41D 13/12; A41D 13/1209; A41D 13/1263; A41D 13/005; A41D 13/007; A41D 2400/38; A41D 2300/22; A62B 35/0018

USPC ... 2/901, 69.5, 227, 70, 71, 72, 76, 79, 456, 2/457, 458, 2.11, 2.14, 2.15; 482/121, 482/124, 125, 126, 139, 907, 67, 69, 92; 182/6; 607/108

See application file for complete search history.

(56) References Cited

U.S. PATENT DOCUMENTS 3,498,408 A * 3/1970 Foote ..... A41D 13/0007 182/6

4,065,814 A * 1/1978 Fox ..... A41D 13/02 2/227

(Continued)

FOREIGN PATENT DOCUMENTS

WO WO 01/10254 A1 2/2001

OTHER PUBLICATIONS http://www.feathersflights.com/2012/04/maxi-dress-week-day-3-elastic.html.*

(Continued)

*Primary Examiner* — Jameson D Collier

(74) *Attorney, Agent, or Firm* — Mueting, Raasch & Gebhardt, PA

(57) ABSTRACT

One or more embodiments of a protective garment and a method of manufacturing such garments are disclosed. In one or more embodiments, the protective garment can include an elastic lumbar panel attached to a rear portion of a body of the protective garment in a waist region, left and right shoulder elastic straps each including a first end attached to a front portion of the body and a second end attached to the rear portion, a left side elastic waist strap attached to the front portion and extending around a left side of the garment where it is attached to the rear portion, and a right side elastic waist strap attached to the front portion and extending around a right side of the garment where it is attached to the rear portion.

18 Claims, 3 Drawing Sheets

(51) Int. Cl.
*A41D 13/12* (2006.01)
*A41D 13/00* (2006.01)

(56) References Cited

U.S. PATENT DOCUMENTS

| | | | | | |
|---|---|---|---|---|---|
| 4,670,913 | A * | 6/1987 | Morell | A41D 13/02 | 2/227 |
| 4,946,453 | A * | 8/1990 | Monson | A41D 13/0017 | 2/2.15 |
| 5,046,194 | A | 9/1991 | Alaniz et al. | | |
| 5,048,124 | A | 9/1991 | Lewis, Jr. et al. | | |
| 5,133,092 | A | 7/1992 | Altinger | | |
| 5,487,189 | A | 1/1996 | Bell | | |
| 5,509,142 | A | 4/1996 | Connell et al. | | |
| 5,716,307 | A * | 2/1998 | Vadher | A43B 7/20 | 482/124 |
| 5,819,322 | A * | 10/1998 | Dicker | A41D 13/0015 | 2/171.3 |
| 5,829,059 | A | 11/1998 | Covington, Jr. | | |
| 5,937,442 | A * | 8/1999 | Yamaguchi | A41D 13/00 | 2/115 |
| 6,006,700 | A * | 12/1999 | Cox | A62B 35/0025 | 119/857 |
| 7,594,281 | B1 * | 9/2009 | Stinson | A62B 17/003 | 2/310 |
| 8,533,864 | B1 | 9/2013 | Kostrzewski | | |
| 2003/0172431 | A1 | 9/2003 | Allen | | |
| 2003/0173150 | A1 | 9/2003 | Sharp et al. | | |
| 2004/0107479 | A1 * | 6/2004 | Dicker | A41D 13/0015 | 2/227 |
| 2005/0278819 | A1 * | 12/2005 | Munn | A41D 13/0007 | 2/69 |
| 2008/0250553 | A1 | 10/2008 | Gatto et al. | | |
| 2009/0019622 | A1 | 1/2009 | Mayfield et al. | | |
| 2009/0236176 | A1 | 9/2009 | Sheu | | |
| 2011/0283446 | A1 | 11/2011 | Baldauf et al. | | |
| 2014/0237710 | A1 | 8/2014 | LaBat et al. | | |

OTHER PUBLICATIONS

Adams et al., "Three Methods for Measuring Range of Motion While Wearing Protective Clothing: A Comparative Study" 1993. *Intl. Journ. of Indus. Ergonomics.* 12:177-191.

Adams et al., "A Model for Protective Clothing Effects on Performance" 1994. *Intl. Journ. of Clothing Science and Technology.* 6(4):6-16.

Adams et al., "The Effect of Size and Fabric Weight of Protective Coveralls on Range of Gross Body Motions" 1995. *Am. Ind. Hyg. Assoc. J.*, 56:333-340.

Adams et al., "Methods for Assessing Protective Clothing Effects on Worker Mobility" 1996. Performance of Protective Clothing: Fifth Volume, ASTM STP 1237. , James S. Johnson and S.Z. Mansdorf, Eds., American Society for Testing and Materials. 17 pages.

Ashdown et al., "Movement Analysis as the Basis for the Development and Evaluation of a Protective Coverall Design for Asbestos Abatement" 1992. Performance of Protective Clothing: Fourth Volume, ASTM STP 1133, James P. McBriarty and Norman W. Henry, Eds., American Society for Testing and Materials, Philadelphia. 16 pages.

Ashdown et al., "Concurrent Engineering in the Design of Protective Clothing: Interfacing with Equipment Design", 1996. Performance of Protective Clothing: Fifth Volume, ASTM STP 1237, James S. Johnson and S.Z. Mansdorf, Eds., American Society for Testing and Materials. 15 pages.

Boorady et al., "Protective Clothing for Pesticide Applicators: A Multimethod Needs Assessment", 2009. *Journal of Textile and Apparel, Technology and Management.* 6(2):1-17.

Bradtmiller et al. "Anthropometric Sizing and Patterning of the New Eagle G-Suit (CSU-20/P)", 1997. Anthropology Research Project, Inc., Box 307, Yellow Springs, OH.

Carroll, "Protective Coveralls: Reborn as a Performance Project". 2000. *Occupational Health & Safety.* 69(5):118-122.

Comfortable Coveralls. *Occupational Health & Safety*, Jun. 2006, 75(6):96.

Easter, "Design of protective clothing," in *Protective clothing systems and materials*, M. Raheel (Ed.), Marcel Dekker, 1994 New York: 25-38.

Henry, Norman W. III. "Four decades of protective clothing development and standardization". *Journal of Chemical Health and Safety.* Nov./Dec. 2007. pp. 15 and 16.

Huck, J. "Protective clothing systems: A technique for evaluating restriction of wearer mobility", 1988. *Applied Ergonomics.* 19(3):185-190.

Huck, J. "Restriction to movement in fire-fighter protective clothing: evaluation of alternative sleeves and liners". 1991. *Applied Ergonomics.* 22.2:91-100.

Huck et al. "Coveralls for grass fire fighting". 1997. *Intern. Journ. of Clothing Science and Technology.* 9(5):346-359.

Huck et al. "Protective Overalls: Evaluation of Garment Design and Fit". 1997. *Intern. Journ. of Clothing Science and Technology.* 9(1):45-61.

International Search Report and Written Opinion for International Application No. PCT/US2014/018050, dated Jun. 10, 2014; 10 pages.

Katz, J. "Fit for Safety". 2007. *FACILITIES.* 2 pages.

Kochar, P. "The Impact of Standardization on Limited-Use Coveralls". 1996. *Occupational Health & Safety.* pp. 22-24.

Laing et al. "Development of sizing systems for protective clothing for the adult male". 1999. *Ergonomics.* 42(10):1249-1257).

Matela. "Personal Protective Equipment should fit the Workplace". 2010. *Safety & Health.* pp. 57-58.

McPherson, "Balancing PPE Protection With Comfort, Fit and Style," *Professional Safety*, Mar. 2008; 53(3): 50-52.

"New Standard Helps Users Choose Clothing for Pesticide Work". OH&S (Occupational Health & Safety). Jul. 31, 2011. 1 page.

Ng et al. "Single Parameter Model of Minimal Surface Construction for Dynamic Garment Pattern Design," 2006, IMACS Multiconference on "Computational Engineering in Systems Applications" (CESA). Oct. 4-6, 2006. Bejing, China. pp. 160-164.

Ng et al. "Dynamic Ease Allowance in Arm Raising of Functional Garment". 2008. *Sen'I Gakkaishi.* 64(9):236-243.

Paquette, "3D Scanning in Apparel Design and Human Engineering," *IEEE Computer Graphics and Applications*, Sep. 1996; 16(5):11-15.

Rosenblad-Wallin. "User-oriented product development applied to functional clothing design". 1985. Applied Ergonomics. 16(4):279-287.

Simplicity Sewing Pattern No. 6199, Kids Animal Costume; 1964; pattern 4, A, p. 3. Retrieved from the Internet http://www.zibbet.com/SewMrsP/artwork?artworkId=1050208; 4pgs.

"Selecting Garments that will be Worn". *OH&S* (*Occupational Health & Safety*). Aug. 1, 2009. 4 pages.

Tan et al. "Design and Evaluation of Thermal Protective Flightsuits. Part I: The Design Process and Prototype Development". 1998. *Clothing and Textiles Research Journal.* 16:47-55.

Turpin-Legendre et al. "Comparison of physiological and subjective strain in workers wearing two different protective coveralls for asbestos abatement tasks". 2003. *Applied Ergonomics.* 34:551-556.

Wang et al. "Body Measurements of Chinese males in dynamic postures and application" 2011. *Applied Ergonomics.* 42:900-912.

Zeigler, J.P. "Proper Sizing: The Key to Extra Durability of Protective Apparel". 2001. *Professional Safety.* pp. 14-15.

International Patent Application No. PCT/US2015/028149, filed Apr. 29, 2015; International Preliminary Report on Patentability dated Nov. 10, 2016; 8 pages.

* cited by examiner

PROTECTIVE GARMENTS AND METHODS OF MAKING

BACKGROUND

Protective garments with elastic straps and methods of making the protective garments are described herein.

Limited-use or disposable garments designed to provide barrier properties such as protective coveralls are known. Coveralls can be used to protect the wearer from an environment or to protect an environment from contamination by a person wearing the garment (e.g., in the case of a cleanroom).

The coverall garments must be worn to provide the desired protection to or from the wearer. Unfortunately, typical disposable coveralls may not fit well, particularly if the wearer must engage in a variety of physical activities such as, e.g., bending, lifting, climbing, etc. To accommodate movement, some coverall designs provide larger waists and torso regions, but excess material can result in baggy, bulky, and uncomfortable garments.

SUMMARY

Protective garments with elastic straps and methods of making the protective garments are described herein.

In one aspect, the present disclosure provides a protective garment that includes a body including a front portion, a rear portion, and a neck opening; a left sleeve attached to the body at a left sleeve opening and a right sleeve attached to the body at a right sleeve opening; a left leg and a right leg extending from the body; a left shoulder region located between the left sleeve opening and the neck opening; a right shoulder region located between the right sleeve opening and the neck opening; a crotch region including a crotch point where the left and right legs meet the body; and a waist region positioned between a waist axis and the crotch point, where the waist axis is transverse to a longitudinal axis of the garment and intersects the longitudinal axis between the left and right sleeve openings and the crotch point. The protective garment can also include an elastic lumbar panel attached to the rear portion of the body in the waist region; a left shoulder elastic strap including a first end attached to the front portion of the body and a second end attached to the rear portion proximate the elastic lumbar panel such that the left shoulder elastic strap extends from the front portion over the left shoulder region to a location proximate the elastic lumbar panel; and a right shoulder elastic strap including a first end attached to the front portion of the body and a second end attached to the rear portion proximate the elastic lumbar panel such that the right shoulder elastic strap extends from the front portion over the right shoulder region to a location proximate the elastic lumbar panel. The protective garment can also include a left side elastic waist strap attached to the front portion of the body and extending around a left side of the garment where it is attached to the rear portion of the body, where the left side elastic waist strap includes a first end proximate the crotch point and a second end proximate the elastic lumbar panel; and a right side elastic waist strap attached to the front portion of the body and extending around a right side of the garment where it is attached to the rear portion of the body, where the right side elastic waist strap includes a first end proximate the crotch point and a second end proximate the elastic lumbar panel.

In another aspect, the present disclosure provides a method of manufacturing a protective garment that includes a body including a left leg and a right leg extending from the body, a left shoulder region located between a left sleeve opening and a neck opening, a right shoulder region located between a right sleeve opening and the neck opening, a crotch region including a crotch point where the left and right legs meet the body, and a waist region positioned between a waist axis and the crotch point, where the waist axis is transverse to a longitudinal axis of the garment and intersects the longitudinal axis between the left and right sleeve openings and the crotch region. The method includes attaching an elastic lumbar panel to a rear portion of the body in the waist region; attaching a first end of a left shoulder elastic strap to a front portion of the body and a second end of the left shoulder elastic strap to the rear portion of the body proximate the elastic lumbar panel such that the left shoulder elastic strap extends from the front portion over the left shoulder region to a location proximate the elastic lumbar panel; and attaching a first end of a right shoulder elastic strap to the front portion of the body and a second end of the right shoulder elastic strap to the rear portion of the body proximate the elastic lumbar panel such that the right shoulder elastic strap extends from the front portion over the right shoulder region to a location proximate the elastic lumbar panel. The method further includes attaching a left side elastic waist strap to the body such that it extends from the front portion of the body around a left side of the garment to the rear portion of the body, where the left side elastic waist strap includes a first end proximate the crotch point and a second end proximate the elastic lumbar panel; and attaching a right side elastic waist strap to the body such that it extends around the right side of the garment to the rear portion of the body, where the right side elastic waist strap includes a first end proximate the crotch point and a second end proximate the elastic lumbar panel.

These and other aspects of the present disclosure will be apparent from the detailed description below. In no event, however, should the above summaries be construed as limitations on the claimed subject matter, which subject matter is defined solely by the attached claims, as may be amended during prosecution.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

BRIEF DESCRIPTION OF THE DRAWINGS

Throughout the specification, reference is made to the appended drawings, where like reference numerals designate like elements, and wherein.

DETAILED DESCRIPTION

Figure 1:
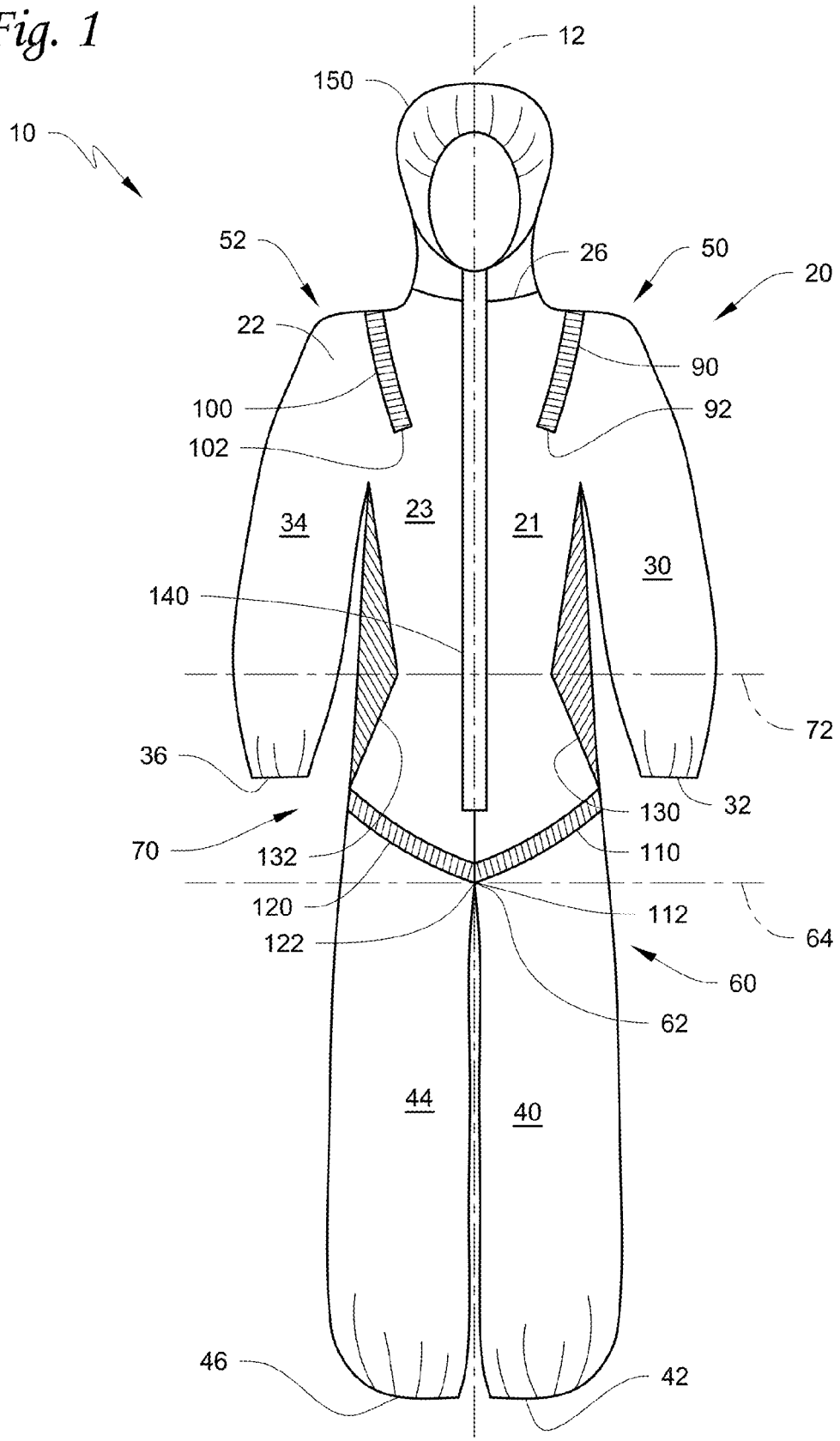
FIG. 1 is a front view of one illustrative embodiment of a garment as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present disclosure.

Protective garments with elastic straps and methods of making the protective garments are described herein. In one or more embodiments, the disclosed garments can provide better fit for a variety of individuals engaged in a variety of physical activities.

In one or more embodiments, the elastic straps are in a contracted state in which excess material in the garment is gathered along the elastic straps. When the wearer bends his or her torso in any direction (e.g., forward, to the right side, to the left side, etc.), the elastic straps elongate and the gathering of the material by the elastic straps is reduced as the elastic straps elongate. In one or more embodiments, the elastic straps and material gathered along them allow for reduced restriction of the movement of a wearer along with a reduced chance of stressing or tearing of the material during that movement.

Figure 2:
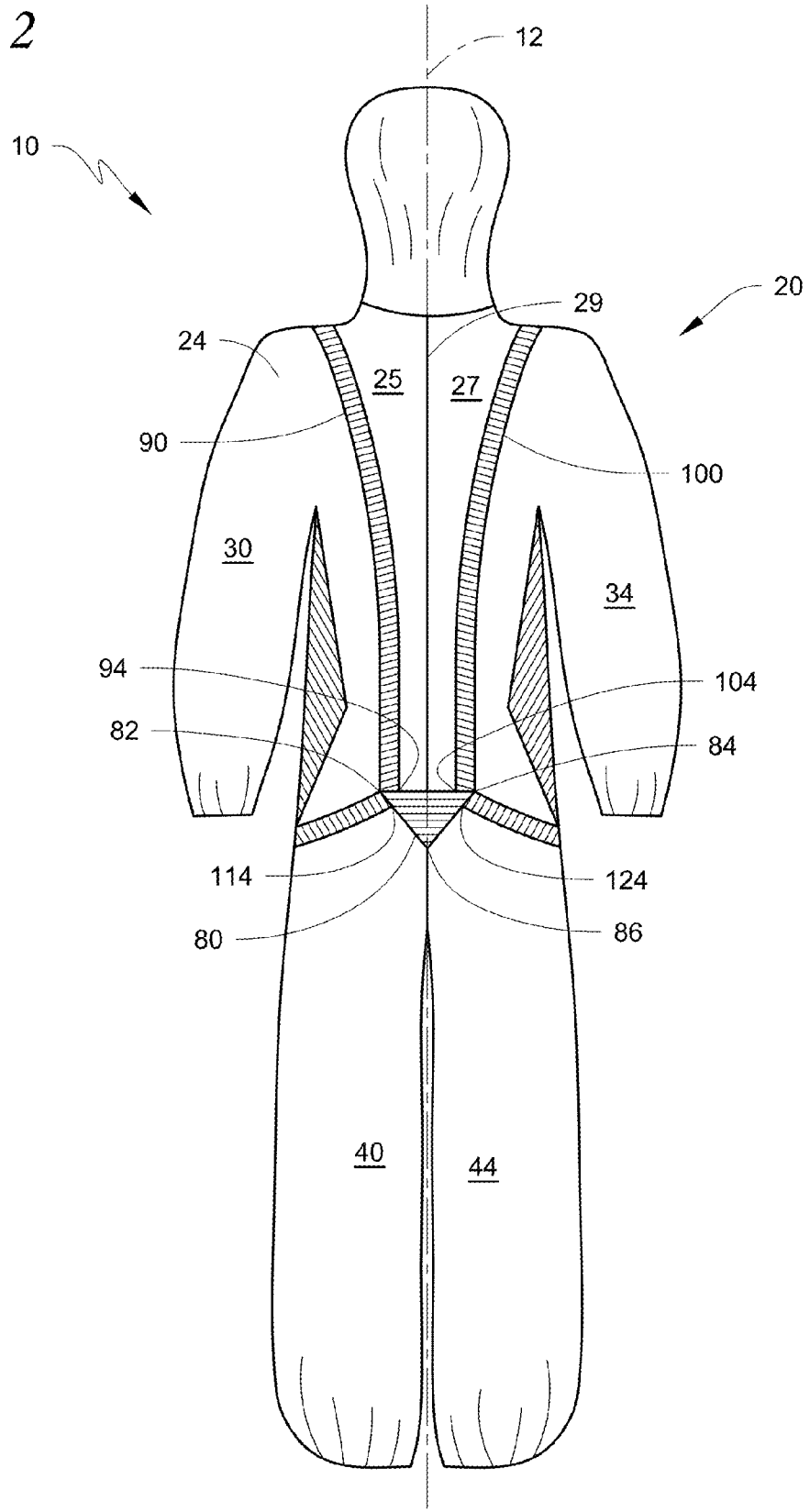
FIG. 2 is a rear view of the garment of FIG. 1.

For example, FIGS. 1-2 are front and rear views of one illustrative embodiment of a protective garment 10. The garment 10 includes a body 20 having a front portion 22 as seen in FIG. 1 and a rear portion 24 as seen in FIG. 2. The front portion 22 includes a front left portion 21 and a front right portion 23. Garment 10 further includes a left sleeve 30 extending from a left sleeve opening (not shown) in the body 20 and a right sleeve 34 extending from a right sleeve opening (not shown) in the body in an upper region of the body (e.g., a region of the body between the right sleeve opening and the left sleeve opening). A left leg 40 and a right leg 44 extend from a lower region of the body 20 (e.g., region of the body below the sleeves 30, 34). Body 20 also includes a left shoulder region 50 located between neck opening 26 and the left sleeve opening from which the left sleeve 30 extends, and a right shoulder region 52 located between the neck opening and the right sleeve opening from which the right sleeve 34 extends. The garment 10 includes the neck opening 26, and, in one or more embodiments, can include a hood 150 extending from the neck opening. In one or more embodiments, the left and right sleeve openings can be positioned proximate the neck opening 26. As used herein, the term "proximate the neck opening" means that an element or feature is closest to or nearest the neck opening than a crotch point of the body.

A crotch region 60 of the body 20 is located below a waist region 70 and can include a crotch point 62 located where the left and right legs 40, 44, meet the body. The crotch region 60 further includes a crotch axis 64 (which may also be viewed as a crotch plane extending into/out of the paper) defined by a horizontal axis that intersects the crotch point 62. The crotch axis 64 intersects a longitudinal axis 12 (which may be viewed as a longitudinal plane extending into/out of the paper) of garment 10 in a generally, or substantially transverse manner when the garment is worn by a person standing upright such that the crotch axis extends horizontally.

The waist region 70 occupies an area of the body 20 above the crotch point 62 and below a waist axis 72. In one or more embodiments, the waist axis 72 is located between the sleeve openings from which the left and right sleeves 30, 34 extend and the crotch point 62. The waist axis 72 (which may also be viewed as a waist plane extending into/out of the paper) intersects the longitudinal axis 12 (or plane) of garment 10 between the left and right sleeve openings and the crotch point 62. In one or more embodiments, the waist axis 72 intersects the longitudinal axis 12 of garment 10 at a midpoint between the left and right sleeve openings and the crotch point 62. Further, in one or more embodiments, the waist axis (or plane) 72 and longitudinal axis (or plane) 12 may intersect in a generally, or substantially transverse manner when the garment is in an unfolded configuration as worn by a person standing upright.

The rear of the garment 10 includes a left rear portion 25 and a right rear portion 27, which, in one or more embodiments, are joined together at a rear seam 29 as depicted in FIG. 2. Although the left rear portion 25 and the right rear portion 27 are depicted as being constructed of a single piece of material joined along rear seam 29, in one or more alternative embodiments, the various portions may be constructed of two or more pieces of material joined along any number of seams as needed. In fact, although the garment 10 as depicted in FIGS. 1-2 includes exemplary panels connected along exemplary seam lines, the various parts of garments as described herein may be formed from any number of pieces and/or seams.

In general, the garment 10 can include a left side and a right side. The left side includes the left front portion 21 and the left rear portion 25, and the right side includes the right front portion 23, and the right rear portion 27.

In one or more embodiments, the garment 10 includes an elastic lumbar panel 80 attached to the rear portion 24 of the body 20 in the waist region 70. The panel 80 includes any suitable elastic material as is further described herein. Although depicted in FIG. 2 as triangular in shape, the elastic lumber panel 80 can take any suitable shape or shapes, e.g., ovoid, circular, polygonal, etc. In one or more embodiments, the elastic lumbar panel 80 includes a perimeter in the shape of a triangle. In one or more embodiments, the elastic lumbar panel 80 is aligned along the longitudinal axis 12 such that, e.g., the longitudinal axis 12 is positioned along a line of symmetry of the elastic lumbar panel 80.

For example, in the embodiment illustrated in FIGS. 1-2, the lumbar panel 80 is triangular in shape. The triangular lumbar panel 80 includes a first vertex 82, a second vertex 84, and a third vertex 86. In one or more embodiments, the lumbar panel 80 can be positioned such that the longitudinal axis 12 bisects the lumbar panel 80 such that the panel is symmetrical about the longitudinal axis. In the illustrated embodiment, the triangular lumbar panel 80 is positioned such that the third vertex 86 is positioned along the longitudinal axis 12 and the side of the lumbar panel 80 located opposite the vertex 86 is bisected by the longitudinal axis. Such an orientation can be defined as a lumbar panel 80 in an "inverted" orientation.

The elastic lumber panel 80 can be attached to the body 20 of garment 10 using any suitable technique or combination of techniques, e.g., adhered, sewn, welded, etc. Further, the elastic lumbar panel 80 can be positioned in any suitable location on the rear portion 24 of the body 20.

In one or more embodiments, the garment 10 includes a left shoulder elastic strap or band 90 and a right shoulder elastic strap or band 100. The left shoulder elastic strap 90 and right shoulder elastic strap 100 can include any suitable elastic material as is further described herein. The left shoulder elastic strap 90 includes a first end 92 attached to the front portion 22 of the body 20 and a second end 94 attached to the rear portion 24 proximate the elastic lumbar panel 80 such that the left shoulder elastic strap extends from the front portion 22 over the left shoulder region 50 to a location proximate the elastic lumbar panel. As used herein, the term "proximate the elastic lumbar panel" means that an element or feature is closest to or nearest the elastic lumbar panel as compared to another element or feature shown in the Figures. For example, the second end 94 of the left shoulder elastic strap 90 is attached to the rear portion 24 such that it is proximate the elastic lumbar panel 80, e.g., closer to the elastic lumbar panel 80 than it is to, e.g., the left shoulder region 50. Alternatively, the term "proximate the elastic lumbar panel" means that the element or feature is located within 6 inches (i.e., 15.24 cm) of the elastic lumbar panel. In one or more alternative embodiments, the element or feature is located within 4 inches (i.e., 10.16 cm) of the elastic lumbar panel. In one or more alternative embodiments, the element or feature is located within 2 inches (i.e., 5.08 cm) of the elastic lumbar panel.

The right shoulder elastic strap 100 includes a first end 102 attached to the front portion 22 of the body 20 and a second end 104 attached to the rear portion 24 proximate the elastic lumbar panel 80 such that the right shoulder elastic strap extends from the front portion over the right shoulder region 52 to a location proximate the elastic lumbar panel 80.

The left and right shoulder elastic straps 90, 100 can be attached to the body 20 of garment 10 using any suitable technique or combination of techniques, e.g., adhered, sewn, welded, etc. And the left and right shoulder elastic straps 90, 100 can be attached to the exterior or interior surface of the body 20. In one or more embodiments, one or more portions of each of the left and right should elastic straps 90, 100 can be attached to the body 20. For example, in one or more embodiments, at least one of the left and right shoulder elastic straps 90, 100 can be attached to the body 20 at only the first end 92, 102 and second end 100, 102 such that the strap is unattached between the first and second ends. In one or more alternative embodiments, at least one of the left and right shoulder elastic straps 90, 100 can be attached to the body 20 along the entire length of the strap.

The first ends 92, 102 of the left and right shoulder elastic straps 90, 100 can be attached to the front portion 22 of the body 20 in any suitable location. For example, in one or more embodiments, one or both of the first ends 92, 102 can be attached proximate the left sleeve opening and right sleeve opening respectively. Further, in one or more embodiments, one or both of the first ends 92, 102 can be attached to the body 20 above the waist region 70. In other embodiments, the first ends 92, 102 can be attached to the body 20 in the waist region 70. The left and right shoulder elastic straps 90, 100 can be attached to the body 20 such that they are straight and/or curved, i.e., one or both of the straps can be positioned along a straight line, a curved line, one or more portions of one or both straps can be positioned along a straight line, or one or more portions can be positioned along a curved line, etc.

Although depicted as being attached to the rear portion 24 of the body 20 proximate the elastic lumbar panel 80, the second ends 94, 104 of the left and right shoulder elastic straps 90, 100 can be attached to the rear portion 24 of the body 20 in any other suitable location. In one or more embodiments, one or both of the second ends 94, 104 can be attached to the lumbar panel 80.

In one or more embodiments, the first end 92 of the left shoulder elastic strap 90 is attached to the left front portion 21 of the body 20, and the second end 94 of the left shoulder elastic strap 90 is attached to the left rear portion 25 of the body. Further, in one or more embodiments the first end 102 of the right shoulder elastic strap 100 is attached to the right front portion 23 of the body 20, and the second end 104 of the right shoulder elastic strap is attached to the right rear portion 27 of the body.

In one or more embodiments, one or both of the left and right shoulder elastic straps 90, 100 do not intersect the longitudinal axis 12. In other embodiments, one or both of the left and right shoulder elastic straps 90, 100 intersect the longitudinal axis 12. In one or more embodiments, the left shoulder elastic strap 90 and the right shoulder elastic strap 100 may intersect each other in any suitable location on the body 20.

In one or more embodiments, the garment 10 also includes a left side elastic waist strap 110 attached to the front portion 22 of the body 20 and extends around a left side of the garment where it is attached to the rear portion 24 of the body. The left side elastic waist strap 110 includes a first end 112 proximate the crotch point 62 and a second end 114 proximate the elastic lumbar panel 80. As used herein, the term "proximate the crotch point" means that the element or feature is closest to or nearest the crotch point as compared to another element or feature shown in the Figures. Alternatively, the term "proximate the crotch point" means that an element or feature is located within 6 inches (i.e., 15.24 cm) of the crotch point. In one or more alternative embodiments, the element or feature is located within 4 inches (i.e., 10.16 cm) of the crotch point. In one or more alternative embodiments, the element or feature is located within 2 inches (i.e., 5.08 cm) of the crotch point.

Further, in one or more embodiments, the garment 10 also includes a right side elastic waist strap 120 attached to the front portion 22 of the body 20 and extends around a right side of the garment where it is attached to the rear portion 24 of the body. The right side elastic waist strap 120 includes a first end 122 proximate the crotch point 62 and a second end 124 proximate the elastic lumbar panel 80.

The left and right side elastic waist straps 110, 120 can include any suitable elastic material as is further described herein. Further, the left and right side elastic waist straps 110, 120 can be attached to the body 20 of garment 10 using any suitable technique or combination of techniques, e.g., adhered, sewn, welded, etc.

The left and right side elastic waist straps 110, 120 can be positioned on the body 20 of garment 10 in any suitable location or pattern. For example, in one or more embodiments, one or both of the left and right side elastic waist straps 110, 120 can be described as extending along a brief line. As used herein, the term "brief line" refers to a line or path that generally traverses around a top of a leg from a side joint of the leg, through the crotch region, and back to the side joint.

Further, in one or more embodiments, the second end 114 of the left side elastic waist strap 110 can be attached to the rear portion 24 of the body 20 proximate the elastic lumbar panel 80 above the crotch point 62 such that the left side elastic waist strap extends along the brief line from the front portion 22 of the body proximate the crotch point around the waist region to proximate the elastic lumbar panel. And in one or more embodiments, the second end 124 of the right side elastic waist strap 120 can be attached to the rear portion 24 of the body 20 proximate the elastic lumbar panel 80 above the crotch point 62 such that the right side elastic waist strap extends along the brief line from the front portion 22 of the body proximate the crotch point around the waist region to proximate the elastic lumbar panel. In one or more embodiments, one or both of first ends 112, 122 of the left and right side elastic waist straps 110, 120 can be attached at an inseam of the body (not shown).

In one or more embodiments, the left side elastic waist strap 110 and the right side elastic waist strap 120 can be combined into a continuous strap. In such embodiments, the first end 112 of the left side elastic waist strap 110 can be considered to be the first end of the continuous strap, and the first end 122 of the right side elastic waist strap 120 can be considered to be the second end of the continuous waist strap, or vice versa. The continuous waist strap would, therefore, extend around the left side of the garment 10, across the left rear portion 25 and right rear portion 27, and back around the right side of the garment.

As mentioned herein, the first ends 92, 102 and second ends 94, 104 of the left and right shoulder elastic straps 90, 100 can be attached to the body 20 of garment 10 in any suitable location. For example, in one or more embodiments, the second end 94 of the left shoulder elastic strap 90 is attached to the second end 114 of the left side elastic waist strap 110 proximate the elastic lumbar panel 80.

Further, in one or more embodiments, the second end 104 of the right shoulder elastic strap 100 is attached to the second end 124 of the right side elastic waist strap 120 proximate the elastic lumbar panel 80.

Further, in one or more embodiments, the second end 94 of the left shoulder elastic strap 90 and the second end 114 of the left side elastic waist strap 110 can be attached to each other and the elastic lumbar panel 80. The second end 104 of the right shoulder elastic strap 100 and the second end 124 of the right side elastic waist strap 120 can also be attached to each other and the elastic lumbar panel 80.

In one or more embodiments where the perimeter of the elastic lumbar panel 80 is triangular, the second end 94 of the left shoulder elastic strap 90 and the second end 114 of the left side elastic waist strap 110 can be attached to the elastic lumbar panel at the first vertex 82 of the triangle. Further, in one or more embodiments, the second end 104 of the right shoulder elastic strap 100 and the second end 124 of the right side elastic waist strap 120 can be attached to the elastic lumbar panel 80 at the second vertex 84 of the triangle.

The left shoulder elastic strap 90 and the left side elastic waist strap 110 can, in one or more embodiments, be combined into a single continuous strap; and the right shoulder elastic strap 100 and the right side elastic waist strap 120 can, in one or more embodiments, be combined into a single continuous strap as well. In other embodiments, the left shoulder elastic strap 90, the right shoulder elastic strap 100, the left side elastic waist strap 110, and the right side elastic waist strap 120 can be combined into a single continuous strap. In such embodiments, the first end 92 of the left shoulder elastic strap 90 can be considered to be the first end of the continuous strap, and the first end 102 of the right shoulder elastic strap 100 can be considered to be the second end of the continuous strap. In such embodiments, the continuous strap can extend from the left front portion 21, over the left shoulder region 50, down the left rear portion 25 to the waist region 70 proximate the elastic lumbar panel 80, around the left side of the garment to the front left portion 21, across the front right portion 23, around the right side to the right rear portion 27, and over the waist region and the right shoulder region 52 to the front right portion 23.

In one or more embodiments, the garment 10 can include a placket 140 positioned on the front portion 22 of the body 20. The placket 140 can be attached to the body 20 using any suitable technique or combination of techniques, e.g., adhered, sewn, welded, etc. The placket 140 can be a separate piece that is attached to the body 20. Alternatively, the placket 140 can be formed in a panel of the garment 10. A free edge of the placket 140 can be attached to the garment 10 using any suitable technique or combination of techniques. For example, a fixed edge of the placket 140 can be permanently fixed to the front portion 22 of the garment 10, and a free edge of the placket 140 can be removably attached to the front portion of the garment using hook and loop fasteners. Further, in one or more embodiments, the garment 10 can include a zipper or other type of closure along a seam on the front portion 22 of the garment that extends along the longitudinal axis 12. In such embodiments, the placket 140 can cover the zipper or other closure such that it is protected from intrusion by outside elements.

In one or more embodiments, one or both of the left and right sleeves 30, 34 can include cuffs 32, 36. These cuffs 32, 36 can include, e.g., elastic such that the garment 20 is fitted around the arms or wrists of a wearer. Further, one or both of the left and right legs 40, 44 can also include cuffs 42, 46 that include, e.g., elastic such that the garment 20 is fitted around the ankles or legs of a wearer.

In one or more embodiments, the garment 10 can include left and right elastic side panels 130, 132. The left elastic side panel 130 can be positioned between the left sleeve opening and the left leg 40, and the right elastic side panel 132 can be positioned between the right sleeve opening and the right leg 44. The elastic panels 130, 132 can be of any shape or material suitable to provide the user good fit, form, and function. Any number of elastic panels 130, 132 occupying up to 100% of the right and left sides of the garment 10 between the sleeve openings and the left and right legs 40, 44 can be provided. The elastic panels 130, 132 may be provided in any suitable location. In other embodiments, the elastic panels 130, 132 can be a single panel occupying a circumferential ring of the garment 10.

The elastic straps, lumber panel, side panels, cuffs, etc. used in the garments described herein may be formed of any suitable construction that provides elasticity in a strap-like or panel form. Some potentially suitable constructions can include, but are not limited to: an elastic article attached to garments using a double-sided adhesive tape (where the double-sided adhesive may, itself, be elastic or inelastic). One example of a potentially suitable elastic article that may be used in one or more embodiments can be, e.g., an article marketed by 3M™ COMPANY as "3M™ FLUTED ELASTIC," which can be paired with a double-sided adhesive tape (or can, in one or more alternative embodiments, be provided with adhesive coated on one side so that it can be attached directly to a garment without requiring the double-sided adhesive tape).

The elastic straps, lumbar panel, side panels, cuffs, etc. used in the garments described herein can, in one or more embodiments, be capable of elastic elongation in the range of about 10% or more (i.e., elastic elongation of at least about 1.1 times an original length such that, for example, an elastic strap having an original length of 1 meter may be elongated to a length of about 1.1 meters or more). At an upper end, elastic straps and panels used in the garments described herein can, in one or more embodiments, be capable of elastic elongation in the range of about 400% or less (i.e., elastic elongation of up to about 4 times an original length such that, for example, an elastic strap having an original length of 1 meter may be elongated up to a length of about 4 meters or less). As used herein, "elastic elongation" (and variations thereof) describe elastic articles, straps, panels, etc. that return to at or near their original length when the elongation force is removed. Depending on the elastic material selected, including the orientation and direction of stretch of the elastic strap, strength, and durability, etc., a greater or lower level of elongation may be required.

The elastic straps and panels as described herein may be attached to the garments as described herein in any manner that allows the elastic straps and panels to extend/lengthen in the presence of an elongation force and retract/shorten when the elongation force is removed. As described herein, the elongation forces may be applied as a user who is wearing the garment moves. Because the elastic straps and panels can be attached to the garments while elongated, removal of the elongation force after attachment will typically cause the material of the garment to be shirred along the length of the elastic straps and panels.

The degree of stretching or elongation of the elastic material during construction of the garments as described herein may vary depending on the elongation, refraction, and adhesive strength properties (as applicable) of the particular elastic material used in the elastic straps and panels. Further, the elastic straps and panels may be attached to the garments such that they are always in a state of tension in the absence of an external elongation force due to the resistance to retraction of the elastic straps and panels provided by the material of the garments to which they are attached.

In one example, the elastic straps and panels used in a garment as described herein may be elongated or stretched 33% before or as they are attached to the material of the garment. For example, a 33 inch (approx. 0.8 m) long strap would be stretched to 44 inches (approx. 1.1 m) before or as it is attached to a garment as described herein. The elastic straps and panels used in garments as described herein may, of course, be provided in a range of lengths to accommodate garments of different sizes to accommodate individuals of different sizes. Other factors considered in selecting the elastic straps and panels and the amount of elongation that is applied to the straps and panels before attaching them to garments as described herein may include, e.g., properties of the elastic material in the elastic straps and panels, properties of material used to construct the garments, manufacturing capabilities, environmental factors (e.g., temperature, humidity, etc.), the desired design characteristics, etc.

Although the elastic straps and panels used in the garments as described herein may exhibit elasticity that is continuous along the entire length of the elastic strap or panel, elastic straps and panels used in other embodiments of garments as described herein may contain portions that exhibit elasticity and other portions that do not exhibit elasticity (e.g., for example, alternating sections of elastic and inelastic material, or regions of varying degrees of elasticity). In still other variations, the elastic straps used in garments as described herein may be continuous along their length or they may be formed of two or more pieces that are overlapped or joined together or placed adjacent to one another to form an elastic strap as described herein. In one or more embodiments, the elastic straps described herein may include specific sections of increased resistance to elongation for improved fit or reinforcement of particular sections of the garments as described herein.

Any suitable technique or combination of techniques can be used to manufacture the garments described herein. Referring to garment 10 of FIGS. 1-2, the garment can be manufactured by attaching the elastic lumbar panel 80 to the rear portion 24 of the body in the waist region 70. The first end 92 of the left shoulder elastic strap 90 can be attached to the front portion 22 of the body 20 and the second end 94 of the left shoulder elastic strap can be attached to the rear portion 24 of the body proximate the elastic lumbar panel 80 such that the left shoulder elastic strap extends from the front portion 22 over the left shoulder region 50 to a location proximate the elastic lumbar panel. The first end 102 of the right shoulder elastic strap 100 can be attached to the front portion 22 of the body 20 and the second end 104 of the right shoulder elastic strap can be attached to the rear portion 24 of the body 20 proximate the elastic lumbar panel 80 such that the right shoulder elastic strap extends from the front portion over the right shoulder region 52 to a location proximate the elastic lumbar panel.

In one or more embodiments, the left side elastic waist strap 110 can be attached to the body 20 such that it extends from the front portion 22 of the body around the left side of the garment 10 to the rear portion 24. Further, in one or more embodiments, the right side elastic waist strap 120 can be attached to the body 20 such that it extends from the front portion 22 of the body around the right side of the body to the rear portion 24.

The first and second side panels 130, 132 can be attached to the body 20 before or after the left and right shoulder elastic straps 90, 100 and/or the left and right side elastic waist straps 110, 120 are attached to the body, or at the same time that the first and right shoulder elastic straps and/or the left and right side elastic waist straps are attached to the body.

In one or more embodiments, one or both of the left shoulder elastic strap 90 and the right shoulder elastic strap 100 can be elongated prior to or after attaching the first ends 92, 102 to the front portion 22 of the body 20. Further, in one or more embodiments, one or both of the left side elastic waist strap 110 and the right side elastic waist strap 120 can be elongated prior to or after being attached to the body 20.

Figure 3:
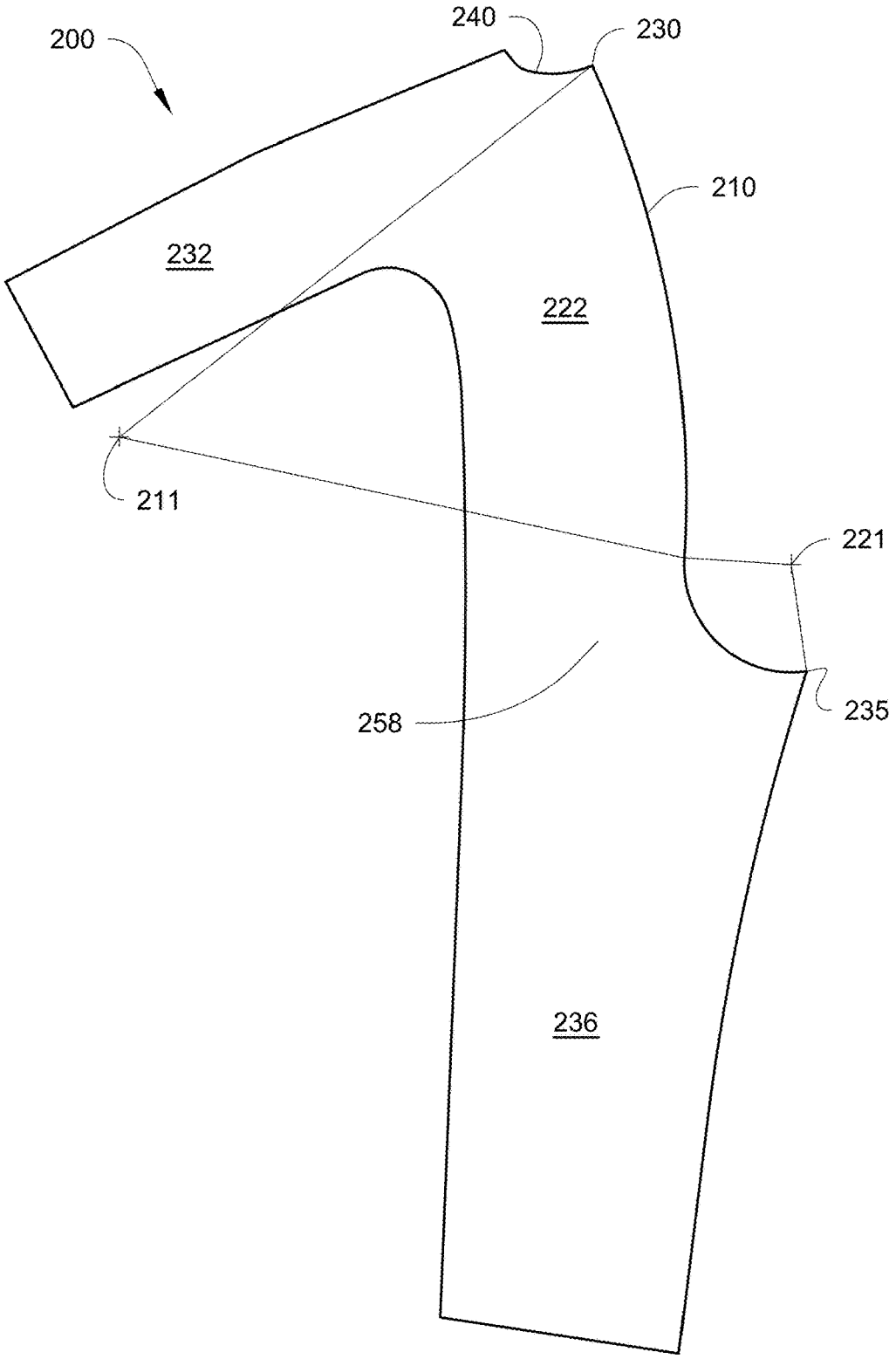
FIG. 3 depicts one illustrative embodiment of a rear panel that could be used to construct a garment as described herein.

Referring to FIG. 3, the garments as described herein may be formed in a pattern that includes panels joined together. In particular, the rear portion of the garment may include a vertical seam line that extends along the rear of the body of the garment from, e.g., the neck opening to the crotch point. For example, reference is made to the seam 29 as depicted in FIG. 2 in connection with the garment 10, in which the seam extends from the neck opening 26 to the crotch point 62.

One illustrative embodiment of a rear panel 200 that may be used in construction of a garment as described herein is depicted in FIG. 3. The rear panel 200 includes a body portion 222, a sleeve 232 extending from the upper region of the body portion 222, and a leg 236 extending from the lower end of the body portion 222.

The first rear panel 200 may further include a seam edge 210 including an upper endpoint 230 proximate the neck region 240, and a lower endpoint 235 located in the crotch region 258. Rear panel 200 may be joined to a second rear panel (where the second rear panel is a mirror image of first rear panel 200 shown in FIG. 3) to form the rear of a garment as described herein. When joined together, the seam edges 210 of the pair of panels would form a rear seam such as, e.g., rear seam 29 as seen in FIG. 2.

The edges 210 of the rear panels 200 may, in one or more embodiments, be curved along their length between upper endpoint 230 and lower endpoint 235 (when the rear panel 200 is laying on a flat surface). In the depicted embodiment, the seam edge 210 includes at least two curves, with a first curve located in an upper portion of the seam edge 210 and a second curve located in a lower portion of the seam edge 210. The upper portions containing the first curves may extend from the ends of the seam edges 210 located proximate the neck openings of the garments as described herein and extending towards the ends of the seam edges 210 located proximate the crotch points of the garments described herein. The lower portions containing the second curves may extend from the ends of the seam edges 210 located proximate the crotch points of the garments as described herein and extending towards the ends of the seam edges 210 located proximate the neck openings of the garments described herein.

The first and second curves of the seam edge 210 can be described as opening in opposite directions such that, e.g., the seam edge 210 could be described as having a generally S-shaped curvature made of two different curves opening in opposite directions from the seam edge 210.

For example, the first curve in the upper portion of the seam edge 210 is curved about a first point 211 located on one side of seam edge 210, while the second curve in the lower portion of the seam edge 210 is curved about a second point 221 located on the opposite side of the seam edge 210. The first curve located in the upper portion of each seam edge 210 may, in one or more embodiments, have a radius of curvature greater than a radius of curvature of the second curve located in the lower portion of the seam edge 210. For example, the first curve in the upper portion of each seam edge 210 may, in one or more embodiments, have a radius of curvature of, e.g., 2 meters or more while the second curve in the lower portion of the seam edge 210 may have a radius of curvature of, e.g., 0.25 meters or more. In both cases, the curves may, in one or more embodiments, have a radius of curvature of 20 meters or less. Because the seam edges 210 are curved, the rear of the garments as described herein may also exhibit some curvature which may enhance the fit and comfort of the garments as described herein.

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A protective garment comprising:

a body comprising a front portion, a rear portion, and a neck opening, wherein the front portion comprises a left front portion and a right front portion, wherein the rear portion comprises a left rear portion and a right rear portion;

a left sleeve attached to the body at a left sleeve opening and a right sleeve attached to the body at a right sleeve opening;

a left leg and a right leg extending from the body;

a left shoulder region located between the left sleeve opening and the neck opening;

a right shoulder region located between the right sleeve opening and the neck opening;

a crotch region comprising a crotch point where the left and right legs meet the body;

a waist region positioned between a waist axis and the crotch point, wherein the waist axis is transverse to a longitudinal axis of the garment and intersects the longitudinal axis between the left and right sleeve openings and the crotch point;

an elastic lumbar panel positioned on the rear portion of the body and attached to the rear portion of the body in the waist region;

a left shoulder elastic strap comprising a first end attached to the left front portion of the body and a second end attached to the left rear portion proximate the elastic lumbar panel such that the left shoulder elastic strap extends from the front portion over the left shoulder region to a location proximate the elastic lumbar panel;

a right shoulder elastic strap comprising a first end attached to the right front portion of the body and a second end attached to the right rear portion proximate the elastic lumbar panel such that the right shoulder elastic strap extends from the front portion over the right shoulder region to a location proximate the elastic lumbar panel;

a left side elastic waist strap attached to the front portion of the body and extending around a left side of the garment where the left side elastic waist strap is attached to the rear portion of the body, wherein the left side elastic waist strap comprises a first end proximate the crotch point and a second end proximate the elastic lumbar panel; and a right side elastic waist strap attached to the front portion of the body and extending around a right side of the garment where the right side elastic waist strap is attached to the rear portion of the body, wherein the right side elastic waist strap comprises a first end proximate the crotch point and a second end proximate the elastic lumbar panel.

2. The protective garment of claim 1, wherein the second end of the left shoulder elastic strap is attached to the second end of the left side elastic waist strap and the elastic lumbar panel, and further wherein the second end of the right shoulder elastic strap is attached to the second end of the right side elastic waist strap and the elastic lumbar panel.

3. The protective garment of claim 1, wherein the left shoulder elastic strap and the left side elastic waist strap are combined into a single continuous strap, and further wherein the right shoulder elastic strap and the right side elastic waist strap are combined into a single continuous strap.

4. The protective garment of claim 1, further comprising left and right elastic side panels, wherein the left elastic side panel is positioned between the left sleeve opening and the left leg, and the right elastic side panel is positioned between the right sleeve opening and the right leg.

5. The protective garment of claim 1, wherein the left and right shoulder elastic straps are adhesively attached to the body.

6. The protective garment of claim 1, wherein the elastic lumbar panel comprises a perimeter in the shape of a triangle.

7. The protective garment of claim 6, wherein the second end of the left shoulder elastic strap and the second end of the left side elastic waist strap are attached to the elastic lumbar panel at a first vertex of the triangle, wherein the second end of the right shoulder elastic strap and the second end of the right side elastic waist strap are attached to the elastic lumbar panel at a second vertex of the triangle.

8. The protective garment of claim 1, wherein the left side elastic waist strap and the right side elastic waist strap are combined into a single continuous waist strap.

9. The protective garment of claim 1, wherein the left shoulder elastic strap, right shoulder elastic strap, left side elastic waist strap, and right side elastic waist strap are sewn onto the body.

10. A method of manufacturing a protective garment that comprises a body comprising a front portion and a rear portion, a left leg and a right leg extending from the body, a left shoulder region located between a left sleeve opening and a neck opening, a right shoulder region located between a right sleeve opening and the neck opening, a crotch region comprising a crotch point where the left and right legs meet the body, and a waist region positioned between a waist axis and the crotch point, wherein the waist axis is transverse to a longitudinal axis of the garment and intersects the longitudinal axis between the left and right sleeve openings and the crotch region, wherein the front portion comprises a left front portion and a right front portion, wherein the rear portion comprises a left rear portion and a right rear portion, wherein the method comprises:

positioning an elastic lumbar panel on the rear portion of the body in the waist region;

attaching the elastic lumbar panel to the rear portion of the body in the waist region;

attaching a first end of a left shoulder elastic strap to the left front portion of the body and a second end of the left shoulder elastic strap to the left rear portion of the body proximate the elastic lumbar panel such that the left shoulder elastic strap extends from the front portion over the left shoulder region to a location proximate the elastic lumbar panel;

attaching a first end of a right shoulder elastic strap to the right front portion of the body and a second end of the right shoulder elastic strap to the right rear portion of the body proximate the elastic lumbar panel such that the right shoulder elastic strap extends from the front portion over the right shoulder region to a location proximate the elastic lumbar panel;

attaching a left side elastic waist strap to the body such that the left side elastic waist strap extends from the front portion of the body around a left side of the garment to the rear portion of the body, wherein the left side elastic waist strap comprises a first end proximate the crotch point and a second end proximate the elastic lumbar panel; and attaching a right side elastic waist strap to the body such that the right side elastic waist strap extends around the right side of the garment to the rear portion of the body, wherein the right side elastic waist strap comprises a first end proximate the crotch point and a second end proximate the elastic lumbar panel.

11. The method of claim 10, further comprising attaching left and right elastic side panels to the body, wherein the left elastic side panel is positioned between the left sleeve opening and the left leg, and the right elastic side panel is positioned between the right sleeve opening and the right leg.

12. The method of claim 10, further comprising elongating the left shoulder elastic strap prior to attaching the first end of the left shoulder elastic strap to the left front portion of the body.

13. The method of claim 12, further comprising elongating the right shoulder elastic strap prior to attaching the first end of the right shoulder elastic strap to the right front portion of the body.

14. The method of claim 10, wherein the second end of the left side elastic waist strap is attached to the second end of the left shoulder elastic strap and the elastic lumbar panel.

15. The method of claim 14, wherein the second end of the right side elastic waist strap is attached to the second end of the right shoulder elastic strap and the elastic lumbar panel.

16. The method of claim 10, further comprising elongating the left side elastic waist strap prior to attaching the left side elastic waist strap to the body.

17. The method of claim 16, further comprising elongating the right side elastic waist strap prior to attaching the right side elastic waist strap to the body.

18. The method of claim 10, wherein attaching the second end of the left shoulder elastic strap further comprises attaching the second end of the left shoulder elastic strap to the elastic lumbar panel, and wherein attaching the second end of the right shoulder elastic strap further comprises attaching the second end of the right shoulder elastic strap to the elastic lumbar panel.

* * * * *